United States Patent [19]

Dahlgren et al.

[11] Patent Number: 4,915,165

[45] Date of Patent: Apr. 10, 1990

[54] PLATE HEAT EXCHANGER

[75] Inventors: Arthur Dahlgren, Lund; Ralf Blomgren, Skanör, both of Sweden

[73] Assignee: Alfa-laval Thermal AB, Tumba, Sweden

[21] Appl. No.: 285,880

[22] PCT Filed: Mar. 25, 1988

[86] PCT No.: PCT/SE88/00146

§ 371 Date: Dec. 12, 1988

§ 102(e) Date: Dec. 12, 1988

[87] PCT Pub. No.: WO88/08508

PCT Pub. Date: Nov. 3, 1988

[30] Foreign Application Priority Data

Apr. 21, 1987 [SE] Sweden ..... 8701634

[51] Int. Cl.[4] ..... F28F 3/08

[52] U.S. Cl. ..... 165/166; 165/167

[58] Field of Search ..... 165/166, 167

[56] References Cited

U.S. PATENT DOCUMENTS

| | | | |
|---|---|---|---|
| 3,783,090 | 1/1974 | Andersson et al. | 165/166 |
| 3,792,730 | 2/1974 | Andersson | 165/167 |
| 4,605,060 | 8/1986 | Andersson et al. | 165/166 |

FOREIGN PATENT DOCUMENTS

| | | | |
|---|---|---|---|
| 47073 | 3/1982 | European Pat. Off. | 165/166 |
| WO8301998 | 6/1983 | PCT Int'l Appl. | 165/166 |
| 458718 | 3/1987 | Sweden . | |
| 1216626 | 3/1986 | U.S.S.R. | 165/166 |
| 1197933 | 7/1070 | United Kingdom | 165/166 |

*Primary Examiner*—Martin P. Schwadron
*Assistant Examiner*—Allen J. Flanigan
*Attorney, Agent, or Firm*—Davis Hoxie Faithfull & Hapgood

[57] ABSTRACT

In a plate heat exchanger, the heat exchange plates of which have been provided by pressing with a corrugation pattern comprising ridges (19*a*, 19*b*) and valleys (20*a*, 20*b*), the ridges and valleys of adjacent plates extend in parallel. In each plate interspace the ridges of adjacent plates abut against each other such that the opposing valleys form parallel flow passages in the plate interspace. The ridges of at least some of the heat exchanger plates are provided with depressions (21*a*, 21*b*), which form thresholds in the valleys formed on the opposite sides of the plates by the ridges. Thresholds of this kind are formed in the heat exchange plates such that they create a substantially larger flow resistance in the plate interspace for one the heat exchange medium than in the plate interspaces for the other heat exchange medium.

8 Claims, 4 Drawing Sheets

PLATE HEAT EXCHANGER

Figure 1:
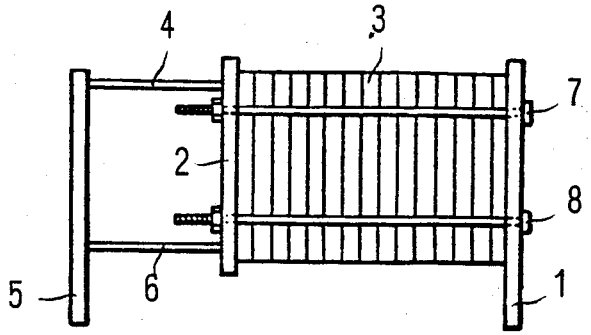

The present invention relates to a plate heat exchanger comprising a package of thin heat exchange plates, which by pressing have been provided with ridges on both sides, through which ridges the plates abut against each other, while forming plate interspaces, and further comprising means for conducting a heat exchange medium through every second plate interspace and another heat exchange medium through the other plate interspaces in a way such that the heat exchange media flow in parallel in a predetermined main direction—countercurrently or concurrently—through their respective plate interspaces, the heat exchange plates being formed such that in the plate interspaces they provide for a larger flow resistance for one of the heat exchange media than for the other.

Plate heat exchangers of this kind are known e.g. by the following patent specifications: GB 1.486.919 (1974), GB 2.025.026 (1979), GB 2.067.277 (1980), U.S. Pat. No. 4.423.772 (1984), U.S. Pat. No. 4.605.060 (1986).

In all of these known plate heat exchangers the heat exchange plates have pressed protuberances in the form of parallel ridges, which are oriented such in the plate interspaces that ridges of one plate cross and abut against ridges of adjacent plates. This arrangement of ridges in the plates has proved advantageously in many respects. Thus, an arrangement of this kind means that a very large number of contact points are created between adjacent plates, whereby the plates without being deformed may be subjected to large clamping forces, even if they are produced by an extremely thin plate material. A thin plate material is desirable for the obtainment of the best possible heat transfer between the heat exchange media and for the obtainment of the cheapest possible plate heat exchanger. Further, an arrangement of ridges of this kind means that the heat exchange media are subjected to heavy turbulence upon through-flow of the plate interspaces. Finally, the provision of ridges in the plates offers a possibility of extensive surface enlargement of the used plate material, so that the heat exchange plates will get as large effective heat exchange surfaces as possible.

As shown in the said patent specifications, the pressed ridges in the plates have been given a certain orientation or have been provided with different kinds of deformations in order to provide larger flow resistance for one of the heat exchange media than for the other. A common drawback of the known technique according to all of said patent specifications is, however, that the difference in flow resistance, which by means of this technique can be accomplished, is relatively small, if it is presumed that a substantially unchanged strength of the plates and an unchanged distance between the plates is desired. This means that many heat exchange duties, where the flow of one heat exchange medium is substantially larger than the flow of the other heat exchange medium, cannot be fulfilled in an effective manner by means of plate heat exchangers of the kind in question. Instead, these heat exchange duties often have to be fulfilled by means of tube heat exchangers, which in several respects are less advantageous than plate heat exchangers.

The object of the present invention is to provide a new design for plate heat exchangers of the initially defined kind, which avoids the above-mentioned limitations of previously known technque as to different flow resistance for the heat exchange media, but which still makes it possible to use a very thin plate material in the heat exchange plates and an effective utilization of this plate material.

This object is obtained according to the invention in a way such that each of at least two adjacent plate interspaces in the heat exchanger is formed by heat exchange plates, each of which on each side has parallel ridges, which across a substantial part of the heat exchange portion of the heat exchange plate extend in said main direction for the flow of the heat exchange media and which between themselves form parallel valleys for the flow of the respective heat exchange medium, the plate portions between the ridges on one side of the plate forming ridges on the other side of the plate; that said ridges on opposing sides of adjacent heat exchange plates abut against each other in each of said two plate interspaces such that said valleys between the ridges of one of the heat exchange plates are situated opposite to corresponding valleys of the other heat exchange plate and form therewith parallel flow passages for the respective heat exchange medium; that at least that heat exchange plate forming a wall of the two said adjacent plate interspaces is provided with depressions at least in its ridges situated on one side of the heat exchange plate, which depressions form thresholds in the mutually parallel valleys on the other side of the heat exchange plate; and that depressions of the said kind are dimensioned and placed such that during operation of the heat exchanger the flow resistance for one of the heat exchange media in the flow passages of one of the plate interspaces is substantially larger than the flow resistance for the other heat exchange medium in the flow passages of the adjacent other plate interspace.

A design according to this invention gives a very large freedom of accomplishing a desired relation between the degrees of flow resistance for the different heat exchange media. This depends on the fact that depressions of ridges on one side of a heat exchange plate of the kind here in question may be formed such that they most substantially influence on the flow resistance for one heat exchange medium without influencing to a substantial degree on the flow resistance for the other heat exchange medium. The reason therefor is that the depressions will form thresholds placed in the middle of the flow passages for said one heat exchange medium while being placed between the flow passages for the other heat exchange medium.

Thus a basic pattern of ridges and valleys of a heat exchange plate of a certain size may easily be changed, e.g. by means of separate tools, in a countless number of different ways by depressing of ridge portions so that exactly the desired flow properties of the plate interspaces for each of two heat exchange media are obtained. Also the kind of special cases may easily be provided for, in which one heat exchange medium changes its state of aggregate during the heat exchange, i.e. condensates or evaporates, while the other heat exchange medium remains in either liquid or gaseous form. Then, the depressions are formed such that the thresholds formed thereby in a plate interspace for the one heat exchange medium creates a gradually changed flow resistance from one end to the other of the plate interspace, seen in the flow direction of the heat exchange medium. For instance, the distance between adjacent thresholds along the same flow passage in the plate interspace may increase in the flow direction of the heat exchange medium, so that the volume of the plate interspace increases per unit of length, seen in the flow direction.

In a British patent specification, GB-PS 1.183.183, a pressing pattern has previously been proposed for heat exchange plates in a plate heat exchanger, in which opposing parallel ridges of adjacent heat exchange plates abut against each other, so that several parallel flow passages are formed between the ridges in each plate interspace for the respective heat exchange media. The proposed pressing pattern is entirely symmetrical, however, whereby all of the plate interspaces offer through-flow resistances of the same magnitude for both of the heat exchange media.

The difference in flow resistance obtainable according to the invention for the two heat exchange media may be made larger or smaller depending upon how the above mentioned depressions in the ridges of adjacent plates are situated in relation to each other. A relatively small increase of the flow resistance in a plate interspace may be obtained by means of depressions, which are formed in the ridges on the sides of two adjacent heat exchange plates turned away from each other such that depressions in one of the heat exchange plates form first thresholds situated at a distance from each other along each of the valleys on the other side of the heat exchange plate, while depressions in the other heat exchange plate form other thresholds situated between the first thresholds along the same valleys.

The smaller the distance is along the same valley between one of said first thresholds and one of said other thresholds, the larger flow resistance will be obtained. Thus, a relatively large increase of the flow resistance in a plate interspace may be obtained, if depressions are formed such in the sides of two adjacent heat exchange plates turned away from each other, that thresholds are formed in the valleys on the opposite sides of the respective heat exchange plates, which thresholds in pairs, i.e. one threshold on each of the heat exchange plates, coact for the forming of restrictions of the flow passages between the heat exchange plates. For instance, for the obtainment of a maximum flow resistance thresholds may be situated opposite to each other in one and the same flow passage. This maximum flow resistance, of course, will be larger the higher the thresholds are.

Depressions of the above described kind need not be evenly distributed across the whole heat exchange portion of a plate. Instead, an uneven distribution of the depressions may be used as a means for controlling of the flow in a plate interspace, e.g. for obtainment of an even distribution of the flow in the plate interspace.

Figure 2:
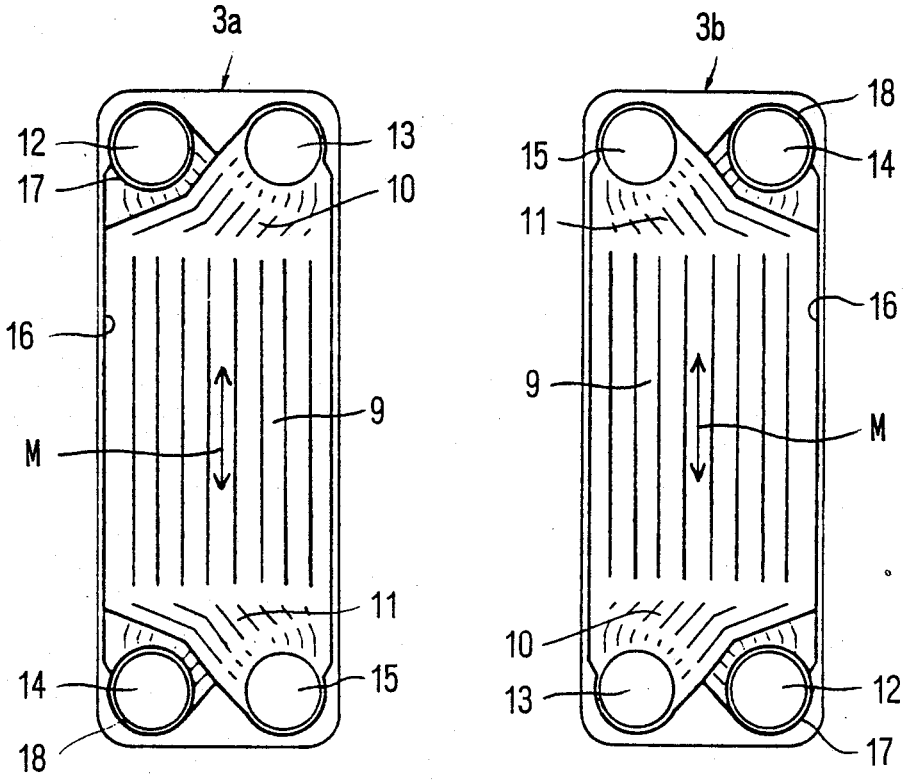
Figure 3:
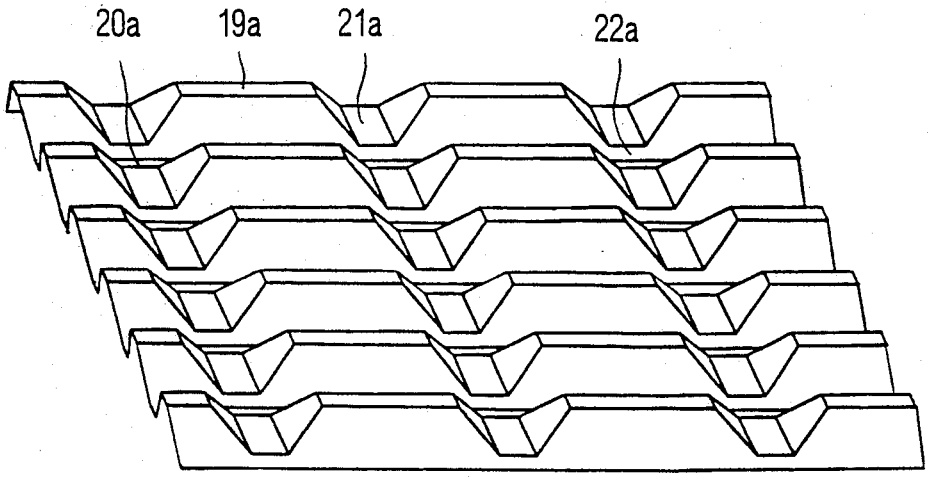
Figure 4:
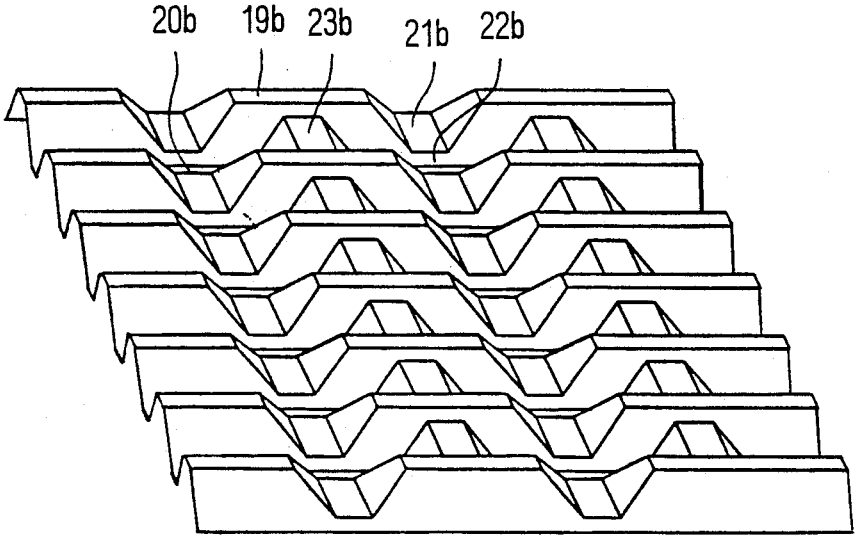
Figure 5:
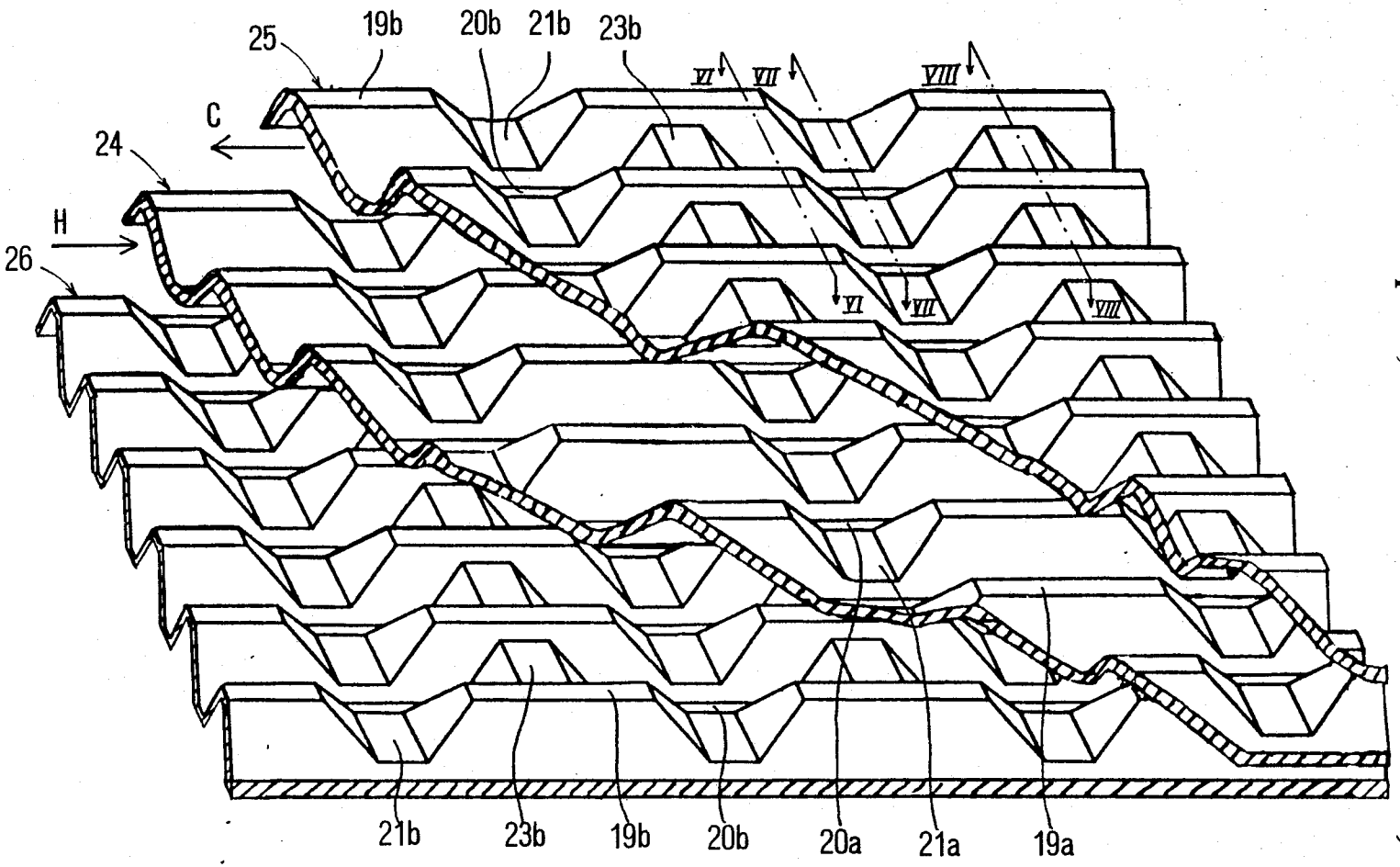
Figure 6:
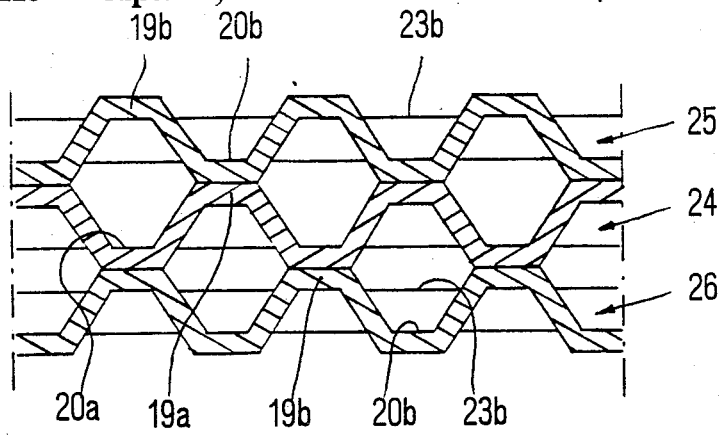
Figure 7:
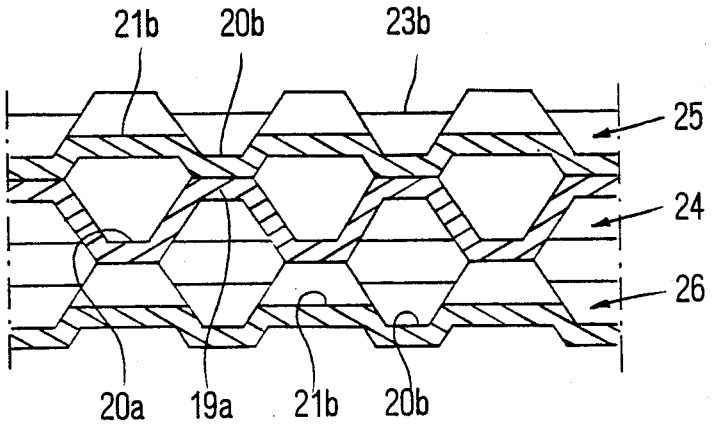
Figure 8:
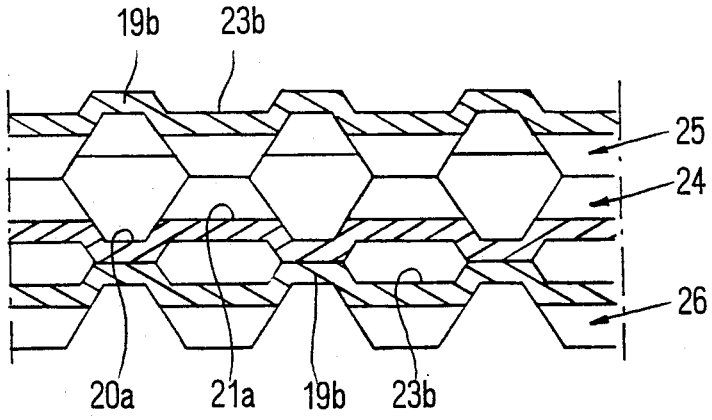

The invention will be described below with reference to the accompanying drawing, in which FIG. 1 shows a plate heat exchanger of the kind concerned by the invention, FIG. 2 shows two heat exchange plates intended for a plate heat exchanger according to FIG. 1, FIGS. 3 and 4 show two different pressing patterns for heat exchange plates, FIG. 5 shows heat exchange plates with pressing patterns according to FIGS. 3 and 4 superimposed for cooperation in accordance with the invention, and FIGS. 6–8 show cross sections along the lines VI—VI, VII—VII and VIII—VIII, respectively, through the heat exchange plates in FIG. 5.

FIG. 1 shows a plate heat exchanger comprising a frame plate 1, a pressure plate 2 and several heat exchange plates 3 situated therebetween. The pressure plate 2 and the heat exchange plates 3 are suspended from and displaceable along a horizontal beam 4, which is supported by the frame plate 1 and a support 5. By means of a guiding rod 6, which also is supported by the frame plate 1 and the support 5, the pressure plate 2 and the heat exchange plates 3 are kept in a correct position. Members 7 and 8 are arranged to keep the heat exchange plates together between the frame plate 1 and the pressure plate 2.

FIG. 2 shows two identical rectangular heat exchange plates **3*a* and 3*b*. The plate 3*a* is turned 180° in its own plane relative to the plate 3*b*. Each of the heat exchange plates comprises a primary heat exchange portion 9 and two secondary heat exchange portions 10 and 11. In the corner portions of the heat exchange plates there are ports 12–15 intended for the through-flow of two heat exchange media. On one side of each plate a gasket 16 extends around the heat exchange portion and two ports 13, 15 of the plate. Separate gaskets 17 and 18 extend around the two other ports 12, 14, which are thus situated outside the area of the plate which is surrounded by the gasket 16**.

The heat exchange plates **3*a* and 3*b* are intended to cooperate in a plate heat exchanger according to FIG. 1** in a way that is well known and, therefore, needs no closer description.

The primary heat exchange portion 9 of each heat exchange plate is formed by pressing with a corrugation pattern having ridges and valleys on both sides of the plate. The ridges and valleys extend in a main direction along the plate, which in FIG. 2 has been indicated by a double arrow M. If the plate **3*a* is put upon the plate 3*b***, opposing parallel ridges of the plates will abut against each other crest by crest in the formed plate interspace. The opposing valleys between the ridges form parallel flow passages for one heat exchange medium in the plate interspace.

FIG. 3 shows an embodiment of a corrugation pattern intended for the primary heat exchange portion of a heat exchange plate. The corrugation pattern has on one side of the heat exchange plate parallel ridges **19*a* and valleys 20*a* extending therebetween. On the other side of the heat exchange plate ridges are formed by the valleys 20*a* and valleys are formed by the ridges 19*a***.

Each ridge **19*a* is provided along its extension with several depressions 21*a* evenly spaced from each other. In FIG. 3 several depressions 21*a* of the ridges 19*a*** are aligned so that a channel is formed across the ridges. This is, of course, not necessary.

As can be seen from FIG. 3, the depressions **21*a* do not have the same depth as the valleys 20*a* but leaves portions 22*a* of the ridges 19*a* situated somewhat higher than the bottoms of the valleys. The depressions 21*a*** form on the opposite side of the heat exchange plate thresholds in the valleys situated there.

By forming of depressions **21*a* only in the ridges on one side of the heat exchange plate an unsymmetrical corrugation pattern has been obtained. Thus, a heat exchange medium will be able to flow within and along the valleys 20*a* on one side of the plate substantially unobstructed, whereas another heat exchange medium upon flow in and along the valleys on the other side of the plate will meet a certain flow resistance due to the thresholds formed by the depressions 21*a***.

FIG. 4 shows another embodiment of a corrugation pattern intended for the primary heat exchange portion of a heat exchange plate. The corrugation pattern has on one side of the heat exchange plate parallel ridges 19b with depressions 21b. Between the ridges 19b valleys 20b are formed, which on the other side of the plate form ridges. These latter ridges have depressions, which in the valleys 20b form thresholds 23b. As can be seen from FIG. 4, the thresholds 23b do not have the same height as the ridges 19b. In a corresponding way the depressions 21b leaves portions 22b of the ridges 19b situated above the bottoms of the valleys 20b.

Along each ridge 19b a threshold 23b is formed between two adjacent depressions 21b. By this arrangement of depressions 21b and thresholds 23b a symmetrical corrugation pattern has been obtained, i.e. ridges, valleys, depressions and thresholds are formed identically on both sides of the heat exchange plate. This means that a heat exchange medium flowing within and along the valleys 20b on one side of the plate will meet exactly the same flow resistance as another heat exchange medium flowing within and along the valleys on the opposite side of the plate.

FIG. 5 shows part of a heat exchange plate 24 with a corrugation pattern according to FIG. 3, situated between parts of two heat exchange plates 25, 26 with a corrugation pattern according to FIG. 4. Between the three plates two plate interspaces are formed, a first heat exchange medium being intended to flow through the lower plate interspace in a direction indicated by an arrow H, and another heat exchange medium being intended to flow through the upper plate interspace in the opposite direction according to an arrow C.

In the lower plate interspace in FIG. 5 the ridges 19b of the lower plate 26 abut against the downwardly directed ridges of the intermediate plate 24, which are formed by the valleys 20a on the upper side thereof. The opposing valleys of the plates 24 and 26 thus form together several parallel flow passages for a first heat exchange medium with a flow direction H. Both the thresholds 23b of the plate 26 and the downwardly directed thresholds formed by the depressions 21a in the intermediate plate 24 will act as an obstacle for a flow in these flow passages. Said thresholds of the plates 24 and 26 are situated opposite to each other in the flow passages, which thereby offer a relatively large flow resistance for a through flowing heat exchange medium.

In the upper plate interspaces in FIG. 5 the ridges 19a of the intermediate plate 24 abut against the downwardly directed ridges of the upper plate 25, which are formed by the valleys 20b on the upper side thereof. The opposing valleys of the plates 24 and 25 form together several parallel flow passages for a second heat exchange medium with the flow direction C. Only the downwardly directed thresholds formed by the depressions 21b in the upper plate 25 are acting as an obstacle for a flow in these flow passages. The flow resistance offered by these flow passages for a through flowing heat exchange medium will be substantially smaller than that offered by the flow passages in the lower plate interspace in FIG. 5.

It is obvious that depressions and thresholds may be formed in heat exchange plates of the shown kind according to very different patterns. Hereby, any desired flow resistance may be accomplished in two adjacent plate interspaces, the degree of flow resistance in one plate interspace being substantially independent of the degree of flow resistance in the other.

FIGS. 6–8 show cross sections along the lines VI—VI, VII—VII and VIII—VIII, respectively, in FIG. 5, from which can be seen how the through flow areas of the flow passages between the plates 24–26 are changing along the flow passages.

It has been described above a case where heat exchange plates with an unsymmetrical pressing pattern (FIG. 3) coacts with heat exchange plates with a symmetrical pressing pattern (FIG. 4) for the obtainment of substantially different flow resistances for the heat exchange media in the respective plate interspaces. The invention is not limited to such a combination of press patterns of the heat exchange plates, however. Alternatively, all of the plates may have either a symmetrical or an unsymmetrical passing pattern. The important thing is that the thresholds formed in the flow passages between the plates by depressions coact in a way such that they accomplish a larger flow resistance in certain plate interspaces than in others.

Within the scope of the invention it is, of course, possible to create different flow resistance for the heat exchange media only in a part of the plate heat exchanger. It is also possible to create a different degree of difference in flow resistance in two different parts of a plate heat exchanger, e.g. according to the principle described in U.S. Pat. No. 4.303.123.

If desirable, the heat exchange plates may be provided with thresholds having different heights. Such thresholds of different heights may be present with one and the same heat exchange plate. For instance, the thresholds on one side of a plate may be higher than the thresholds on the other side of the plate. Alternatively, certain plates may have thresholds of a certain height and other heat exchange plates may have thresholds of a different height. Preferably, the pressed ridges have the same height in all of the heat exchange plates, however, so that the same kind of gaskets may be used in the different plate interspaces.

For the obtainment of different flow resistances for the heat exchange media it is further possible to form the heat exchange plates in a way such that every second heat exchange plate in a plate heat exchanger (or part thereof) may be turned 180° around an axis extending in the plane of the plate, the various thresholds being formed such—with respect to location and/or height—that they coact in different ways in the formed plate interspaces for the respective heat exchange media. Heat exchange plates arranged in this way, thus, may have identical pressing patterns of ridges, valleys, depressions and thresholds.

Within the scope of the accompanying claims the invention can be used even for plate heat exchangers, in which some or all of the heat exchange plates are permanently connected with each other, e.g. by soldering or welding.

We claim:

1. Plate heat exchanger comprising a package of thin heat exchange plates, which have been provided by pressing with ridges on both sides, through which ridges the plates abut against each other while forming plate interspaces, and further comprising means for conducting a heat exchange medium through every second plate interspace and another heat exchange medium through the other plate interspace in a way such that the heat exchange media flow in parallel with each other in a predetermined main direction—countercurrently or concurrently—through their respective plate interspaces, the heat exchange plates being formed such that they provide in the plate interspaces a larger flow resistance for the one heat exchange medium than for the other, characterized in that each of at least two adjacent plate interspaces (C, H) in the heat exchanger are formed by heat exchange plates, each of which on each side has parallel ridges (19*a;* 19*b*) which across a substantial part of the heat exchange portion of the heat exchange plate extend in said main direction for the flow of the heat exchange media and which between themselves form parallel valleys (20*a;* 20*b*) for the flow of the respective heat exchange medium, the plate portions between the ridges (19*a;* 19*b*) on one side of the plate forming ridges on the other side of the plate, the ridges on opposing sides of adjacent heat exchange plates abut against each other in each of said two plate interspaces (C, H) such that said valleys (20*b*) between the ridges (19*b*) of one heat exchange plate (26) are situated opposite to corresponding valleys of the other heat exchange plate (24) and forming therewith parallel flow passages for the respective heat exchange medium, at least the heat exchange plate (24) forming a wall of the two said adjacent plate interspaces is provided with depressions (21*a*) at least in its ridges (19*a*) situated on one side of the beat exchange plate, which depressions form thresholds in the mutually parallel valleys on the other side of the heat exchange plate, and depressions (21*a*) of the said kind are dimensioned and located such that during operation of the heat exchanger the flow resistance for one heat exchange medium in the flow passages of one (C) of the plate interspaces is substantially larger than the flow resistance for the other heat exchange medium in the flow passages of the adjacent other plate interspace (H).

2. Plate heat exchanger according to claim 1, characterized in that depressions (21*a*) of the said kind are formed such in the ridges on the sides of two adjacent heat exchange plates (24, 26), turned away from each other, that depressions (21*a*) of one heat exchange plate form first thresholds situated at a distance from each other along each of the valleys on the other side of the heat exchange plate (24), whereas depressions in the other heat exchange plate (26) form other thresholds (23*b*) situated between the first thresholds along the same valleys, the thresholds of the two heat exchange plates (24, 26) forming restrictions in the respective flow passages between the heat exchange plates.

3. Plate heat exchanger accordin to claim 1, characterized in that depressions (21*a*) of the said kind are formed such in ridges on the sides of two adjacent heat exchange plates (24, 26), turned away from each other, that threshold are formed in the valleys on the opposite sides of the respective heat exchange plate, which thresholds in pairs, i.e. one threshold on each of the heat exchange plates, coact for forming of restrictions in the flow passages between the heat exchange plates.

4. Plate heat exchanger according to claim 2 or 3, characterized in that three subsequent heat exchange plates are formed such that one of the formed plate interspaces has restrictions situated according to claim 2, whereas the other plate interspace has restrictions situated according to claim 3.

5. Plate heat exchanger according to any of claims 1–4, characterized in that every second heat exchange plate (24) of several subsequent heat exchange plates has a first pattern of ridges and valleys and the other heat exchange plates (25, 26) have a second pattern of ridges and valleys different from said first pattern.

6. Plate heat exchanger according to claim 1, characterized in that the depressions in the ridges of the plates are formed such that the thresholds formed thereby in a plate interspace for one heat exchange medium create a gradually changing flow resistance from one end to the other of the plate interspace, seen in the flow direction of the heat exchange medium.

7. Plate heat exchanger according to claim 6, characterized in that the distance between adjacent thresholds along the same flow passage in the plate interspace changes in the flow direction of the heat exchanger medium.

8. Plate heat exchanger according to claim 1, characterized in that the heat exchange plates have an identical pattern of ridges (19*a,* 19*b*) and valleys (20*a,* 20*b*) but depressions (21*a,* 21*b,* 23*b*) formed differently in their respective ridges.

* * * * *